US006195822B1

(12) United States Patent
Sorensen et al.

(10) Patent No.: US 6,195,822 B1
(45) Date of Patent: Mar. 6, 2001

(54) PATIENT TRANSPORT BAG

(76) Inventors: David Charles Sorensen; Rachel Gertrude Sorensen, both of 9238 - 111 Avenue, Grande Prairie, Alberta (CA), T8V 4S5

( * ) Notice: Subject to any disclaimer, the term of this patent is extended or adjusted under 35 U.S.C. 154(b) by 0 days.

(21) Appl. No.: 09/275,982

(22) Filed: Mar. 25, 1999

(30) Foreign Application Priority Data

Nov. 2, 1998 (CA) ..... 2252339

(51) Int. Cl.[7] ..... A61G 1/00
(52) U.S. Cl. ..... 5/628; 5/629; 5/625
(58) Field of Search ..... 5/628, 629, 625, 5/413 R, 413 AM; 128/869

(56) References Cited

U.S. PATENT DOCUMENTS 4,301,791 * 11/1981 Franco ..... 5/628 X
5,189,746 * 3/1993 Horie ..... 5/628 X
5,249,321 * 10/1993 Graf ..... 5/628 X
5,386,604 2/1995 Ricketts ..... 5/625
5,699,568 * 12/1997 Couldridge ..... 5/628

* cited by examiner

*Primary Examiner*—Terry Lee Melius
*Assistant Examiner*—Fredrick Conley
(74) *Attorney, Agent, or Firm*—Christensen O'Connor Johnson Kindness PLLC

(57) ABSTRACT

A patient transport bag includes a fabric base having a bottom and four sides which define an interior cavity. The base is securable to a stretcher. A top cover is detachably secured to the base. Straps are provided for securing the top cover as a roll along one of the four sides. The patient transport bag, as described, is attachable to a stretcher in such a manner that it is ready for immediate use.

19 Claims, 6 Drawing Sheets

PATIENT TRANSPORT BAG

FIELD OF THE INVENTION

The present invention relates to a patient transport bag.

BACKGROUND OF THE INVENTION

With virtually all serious injuries, there is a danger that an injured person will suffer from shock. To minimize the effect of shock, the injured person should be kept comfortable. This requires that the person be sheltered from the elements, such as wind, rain, excessive heat or excessive cold.

Patient transport bags are being used to shelter injured persons from the elements. An example of a patient transport bag is U.S. Pat. No. 5,386,604 which was issued to Ricketts in 1995. The Ricketts reference discloses a patient transport bag which comes in two separate halves that can be used as blankets. The two halves are capable of being joined together to form an enclosure to protect an injured person from the elements.

As patient transport bags become more widely used various shortcomings are being discovered. One example of such a shortcoming relates to the time it takes to enclose an injured person within the confines of the patient transport bag. In a patient transport situation time can mean the difference between life and death for the injured person.

SUMMARY OF THE INVENTION

What is required is a patient transport bag that enables a patient to be positioned within the bag rapidly.

According to the present invention there is provided a patient transport bag which includes a fabric base having a bottom and four sides which define an interior cavity. Means is provided for securing the base to a stretcher. A top cover is detachably secured along at least three of the four sides of the base. Straps are provided for securing the top cover as a roll along one of the four sides.

The patient transport bag, as described above, is attachable in advance to a stretcher ready for use. It is preferred that a mattress which usually accompanies the stretcher be positioned within the interior cavity of the base. This maximizes both speed and patient comfort.

Although beneficial results may be obtained through the use of the patient transport bag, as described above, the size of the patients may vary widely from infants to persons weighing in excess of 300 pounds. Even more beneficial results may be obtained when the four sides of the base are expandable. Beneficial results have been obtained through the use of compression straps positioned at intervals along at least two of the four sides. This allows the sides to be compressed to accommodate contours of the patient's body.

Although beneficial results may be obtained through the use of the patient transport bag, as described above, the positioning of such equipment as oxygen bottles, and intravenous pumps and monitors presents a continual problem. Even more beneficial results may, therefore, be obtained when means is provided for securing such equipment to the top cover.

Although beneficial results may be obtained through the use of the patient transport bag, as described above, there are times when either for warmth or patient restraint the patients upper body must be covered. Even more beneficial results may, therefore be obtained when the top cover includes a yoke-like shoulder restraint. This yoke-like shoulder restraint can be folded out of the way when not required.

Although beneficial results may be obtained through the use of the patient transport bag, as described above, patient access, for example for an intravenous, is continually an issue. Even more beneficial results may, therefore, be obtained when the top cover has a top, a bottom and two sides and an closable opening is positioned between the two sides adjacent the top of the top cover. This allows access through the middle of the top cover in addition to access through the sides. There are a variety of ways to create a closable opening. It is preferred that the means for detachably securing the top cover to the base include a two way zipper along at least three of four sides. It is also preferred that the means for closing the centrally positioned closable opening in the top include a two way zipper. It has been found that a two way zipper provides the most secure mode of fastening while maintaining convenient and rapid patient access. With a two way zipper only that area in which access is required need be opened.

Although beneficial results may be obtained through the use of the patient transport bag, as described above, when a patient is transferred a chart and some addition paperwork must accompany the transfer. Even more beneficial results may, therefore, be obtained when a pocket with a transparent window is provided such that paperwork relating to the patient can be seen through the transparent pocket when positioned in the pocket.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
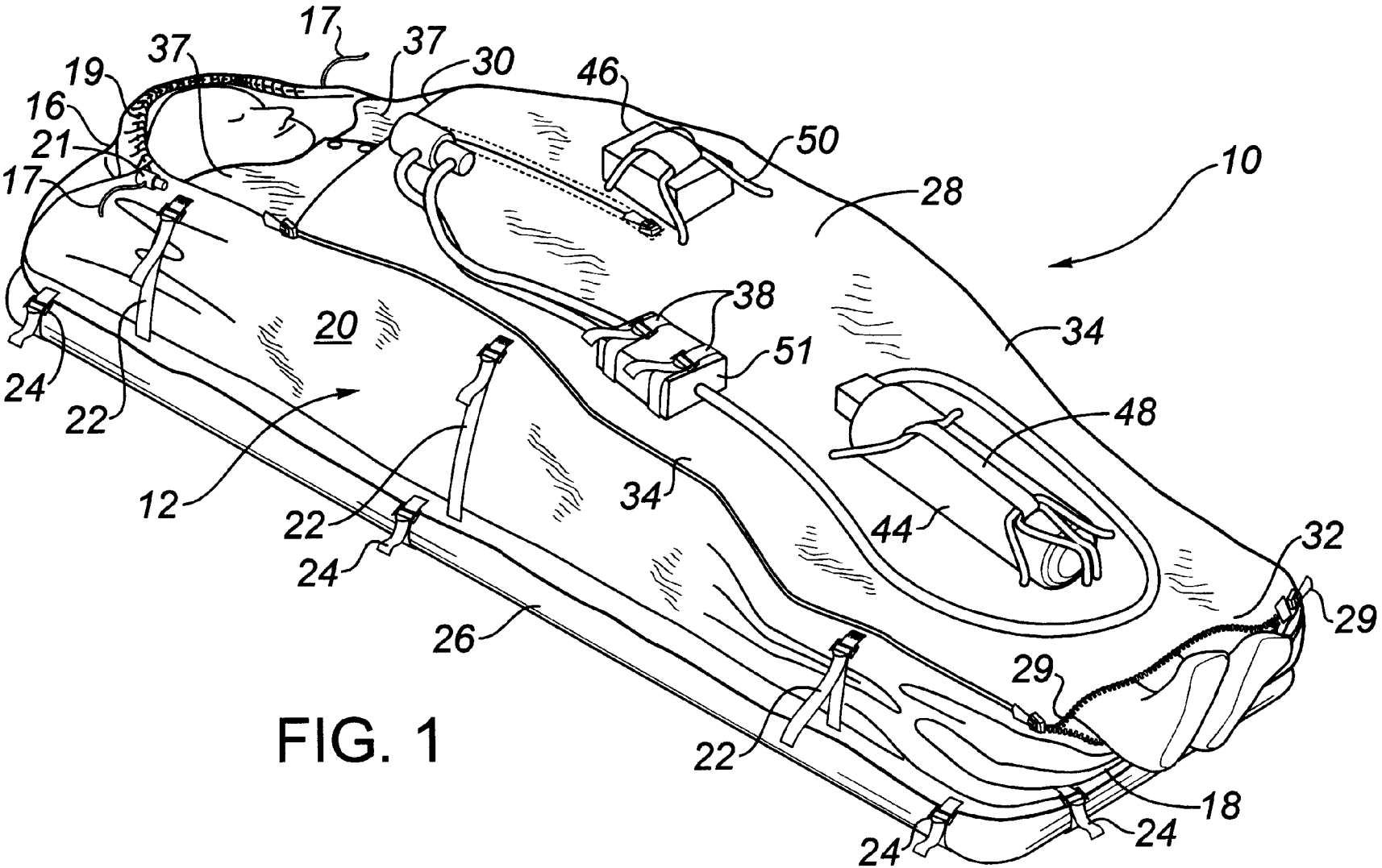
FIG. 1 is perspective view of a patient transport bag constructed in accordance with the teachings of the present invention.

The preferred embodiment, a patient transport bag generally identified by reference numeral 10, will now be described with reference to FIGS. 1 through 9.

Figure 2:
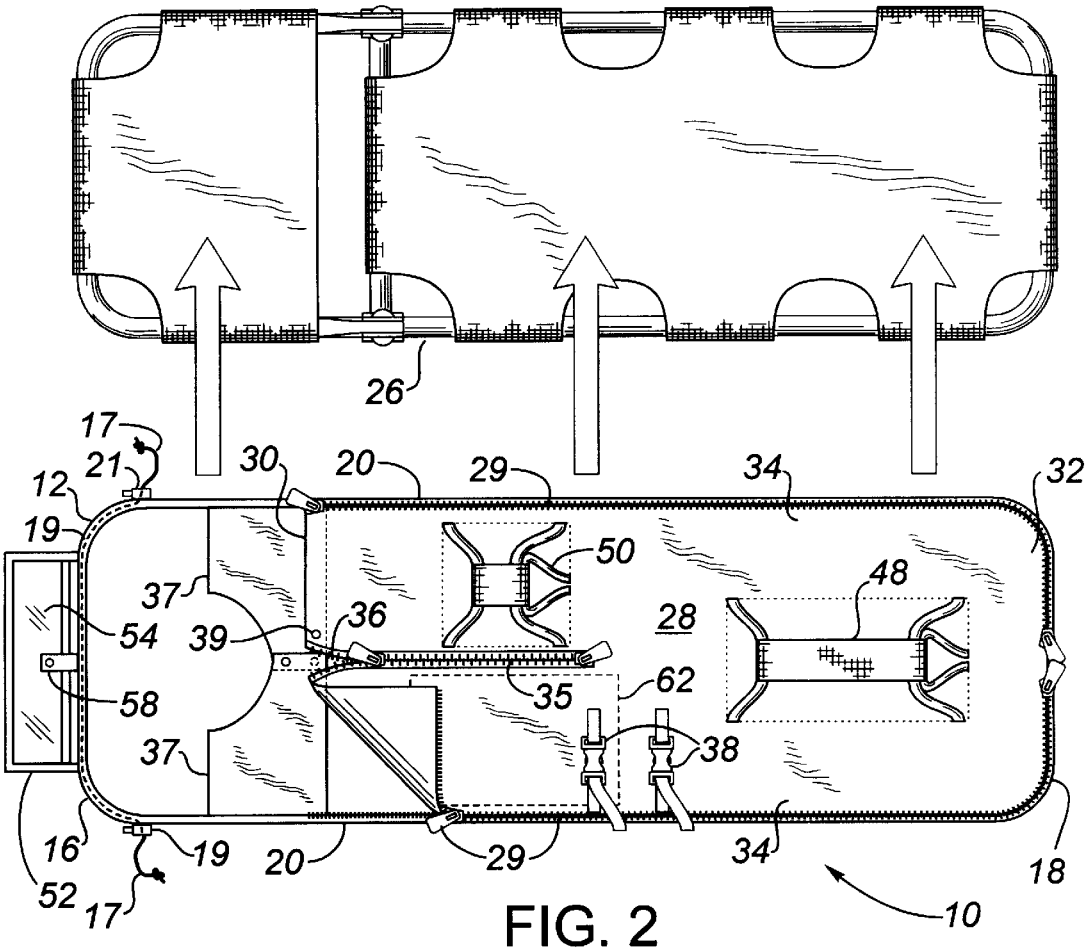
FIG. 2 is exploded top plan view of the patient transport bag illustrated in FIG. 1.
Figure 3:
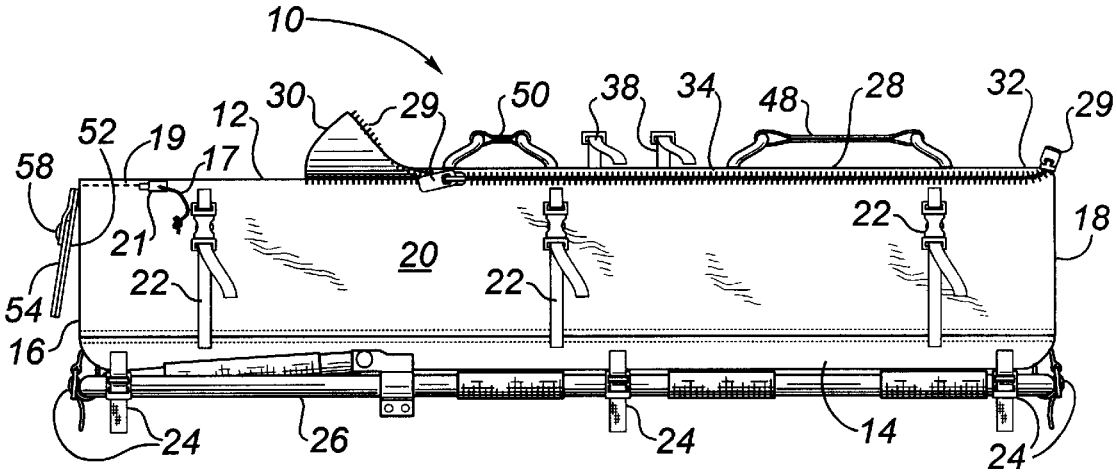
FIG. 3 is side elevation view of the patient transport bag illustrated in FIG. 1.
Figure 7:
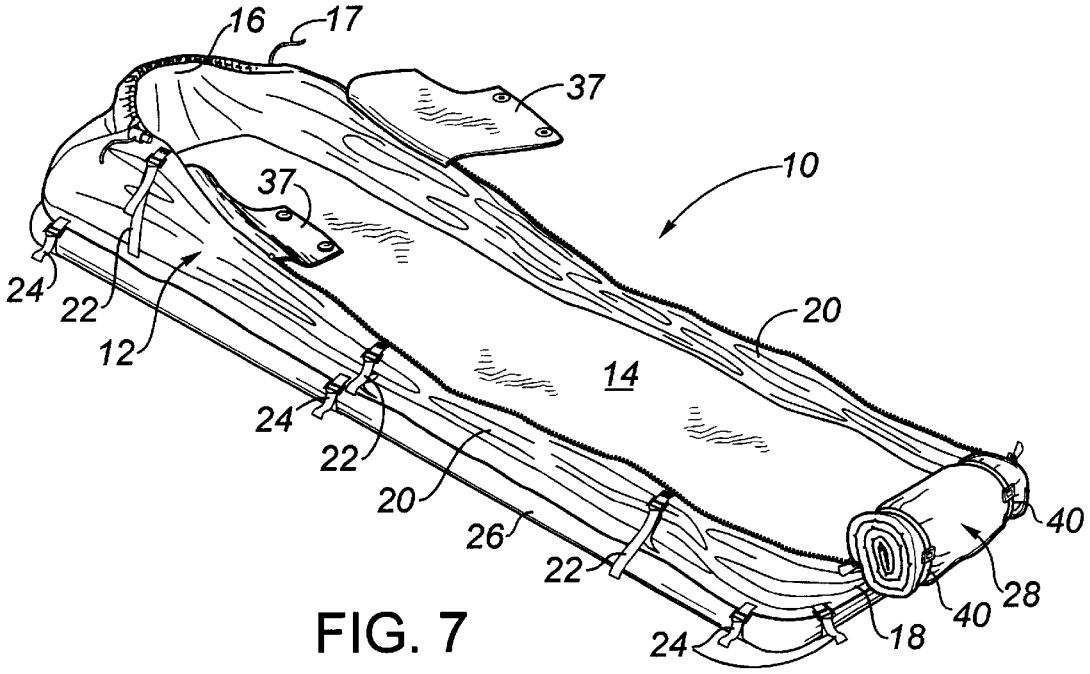
FIG. 7 is a perspective view of the patient transport bag illustrated in FIG. 1 in position on a stretcher with top cover rolled up on one end.
Figure 8:
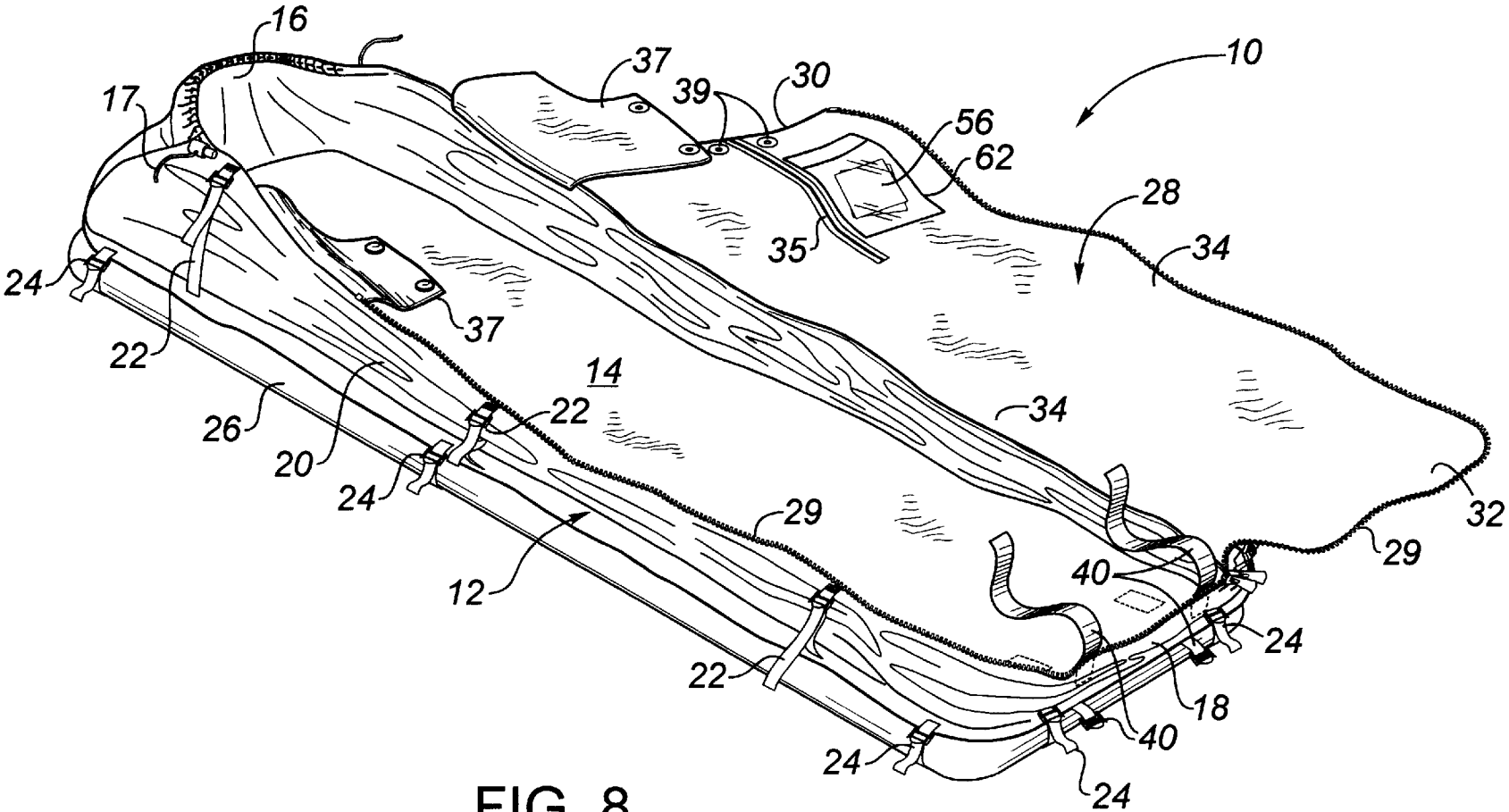
FIG. 8 is a perspective view of the patient transport bag illustrated in FIG. 1 in position on a stretcher with top cover suspended off one side.

Referring to FIGS. 1 through 5, patient transport bag 10 includes a fabric base 12 having a bottom 14, a head 16, a foot 18 and two sides 20 which define an interior cavity. The head 16, foot 18 and two sides 20 of the base are expandable with compression straps 22 positioned at intervals along two sides 20. Optionally, compression straps 22 could also be placed at intervals along the foot 18 and head 16. Referring to FIG. 8, the manner in which fabric base 12 may be expanded is illustrated, along with the manner in which sides 20 are compressed by compression straps 22 to accommodate contours of a patient's body. With reference to FIGS. 3 and 7, a plurality of straps 24 are positioned at intervals around the base 12, whereby the base 12 is secured to a stretcher 26 in a manner that prevents movement of the bag 10 relative to the stretcher 26.

Figure 4:
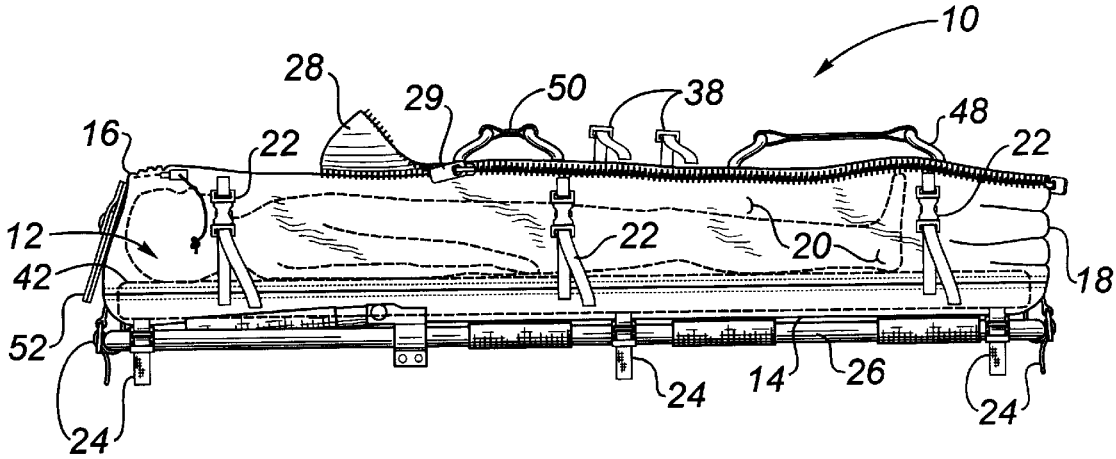
FIG. 4 is a side elevation view of the patient transport bag illustrated in FIG. 1 in position on a stretcher with a patient inside the patient transport bag.
Figure 5:
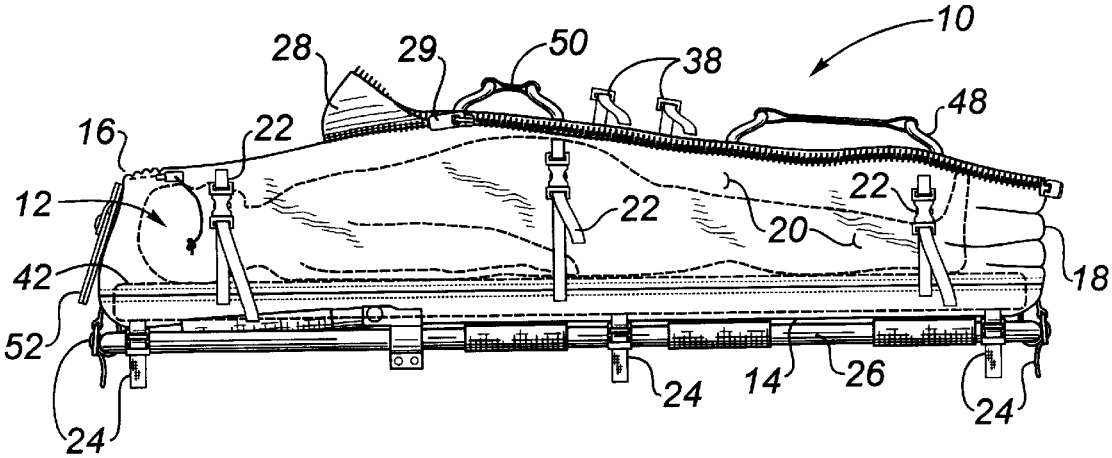
FIG. 5 is a side elevation view of the patient transport bag illustrated in FIG. 4 in position on a stretcher with an obese or near term pregnant patient inside the patient transport bag.

With reference to FIGS. 1 and 5, a top cover 28 is detachably secured along at least the foot 18 and two sides 20 of the base 12. Top cover 28 may optionally be detachably secured to head 16 of the base 12. Top cover 28 is detachably secured to base 12 by means such as two-way zippers 29. The top cover 28 has a top 30, a bottom 32 and two sides 34, and a closable opening 36 positioned between the two sides 34 and adjacent the top 30 of the top cover 28 as illustrated in FIG. 2. The two sides 34 are detachably secured to each other by means such as a zipper 35 as illustrated in FIG. 2. Shoulder straps 37 are provided to secure and protect the upper body of a patient in a yolk-like manner. The shoulder straps 37 are detachably secured to the sides 20 of the base 12 close to the head 16 of the base 12 as illustrated in FIG. 2. When in restraining position the shoulder straps 37 are each also detachably secured to sides 34 of top cover 28 at a position indicated by the numeral 39. When not in use the shoulder straps 37 are folded down inside bag 10. Optionally an insulating lining, such as the material known by the trade name Thinsulate, may be detachably secured to one or both of base 12 and top cover 28. Straps 40 are provided for securing the top cover 28 as a roll along the foot 18 or one of the two sides 20 of the base 12 as illustrated in FIGS. 7 and 8. Referring to FIG. 4, A mattress 42 is optionally positioned within the interior cavity of base 12.

Referring to FIG. 1, top cover 28 has elastic pockets 48 and 50, along with straps 38. Referring to FIG. 1, there is illustrated the manner in which medical equipment such as an oxygen bottle 44 or an intravenous pump 46 is secured in elastic pockets 48 and 50. Intravenous lines from intravenous pump 46 and equipment requiring access from both ends, such as a ventilator 51, is secured using straps 38.

With reference to FIGS. 2 through 6, a pocket 52 is provided. Pocket 52 has a transparent window 54, so that paperwork or other contents within pocket 52 are visible. Detachable means such as a snap 58 is provided to close pocket 52. With reference to FIG. 8, a pocket 62 is also positioned on an inside surface of top cover 28. Pocket 62 also has a transparent window 56, so that paperwork or other contents within pocket 62 are visible.

Figure 9:
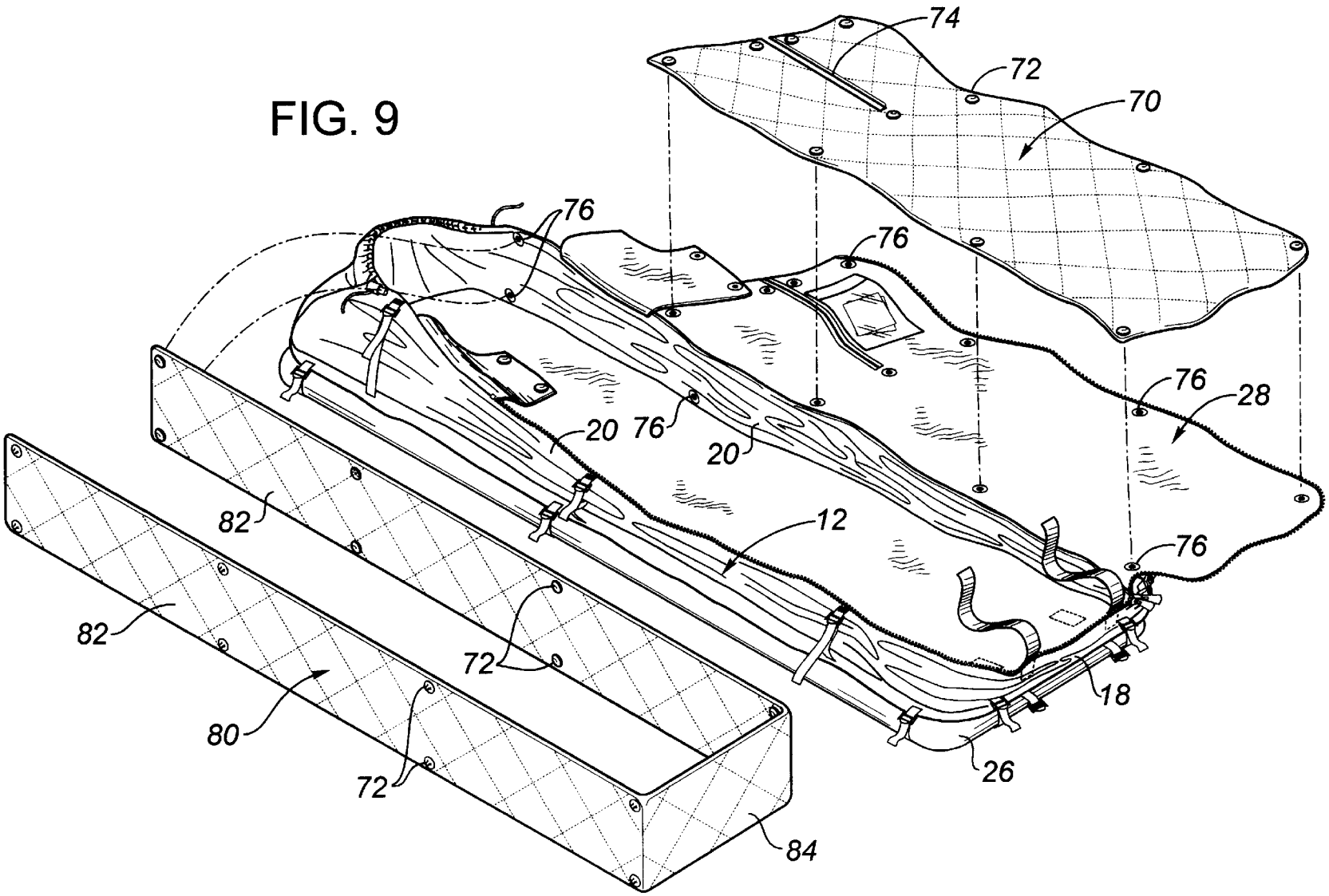
FIG. 9 is a exploded perspective view of the patient transport bag illustrated in FIG. 1.

Referring to FIG. 9, there is illustrated a removable top lining generally indicated, by reference numeral 70 and a removable interior lining generally indicated by reference numeral 80. Top lining 70 and interior lining 80 are used whenever there is a concern about keeping the patient warm in inclement weather conditions. Top lining 70 has snap fasteners 72 that mate with snap fasteners 75 on top cover 28 to secure top lining 70 to top cover 28. Top lining 70 has a slotted opening 74 where closable opening 36 is positioned in top cover 28. Interior lining 80, similarly, has snap fasteners 72 that mate with snap fasteners 76 within base 12 to secure interior lining 80 within base 12. Referring to FIG. 2, a draw chord 17 is positioned in a passage 19 that extends transversely across head 16 of base 12. Chord clamps 21 are positioned on chord 17. By adjusting the positioning of chord clamps 21 along chord 17, head 16 of base 12 can be constricted to assume an arcuate contour as illustrated in FIG. 7, to reduce the exposure of the patient's head to the elements.

Figure 6:
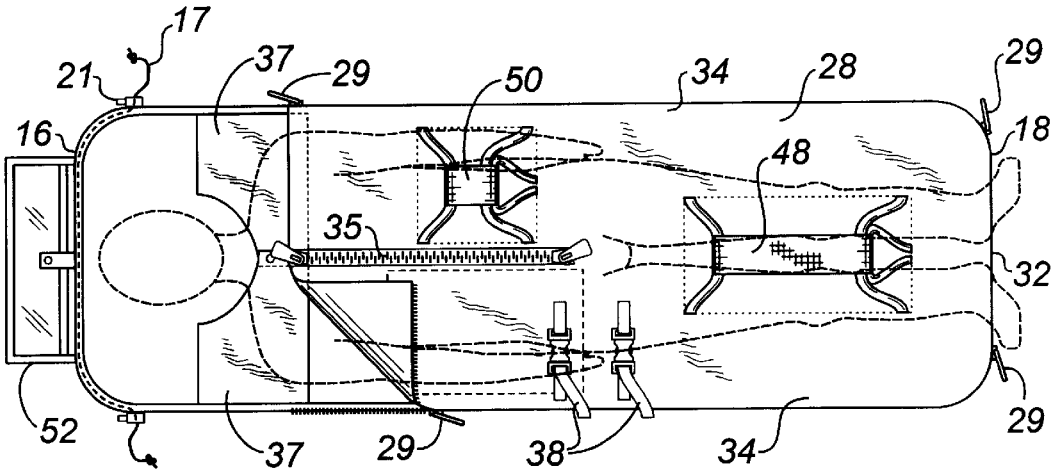
FIG. 6 is a top plan view of the patient transport bag illustrated in FIG. 5.

The use and operation of patient transport bag 10 will now be described with reference to FIGS. 1 through 9. In preparation for use, patient transport bag 10 is secured to stretcher 26 by straps 24 as illustrated in FIG. 4. Mattress 42 is placed with base 12 and top cover 28 is rolled and secured at foot 18 of base 12 as illustrated in FIG. 7. Compression straps 22 along sides 20 are used to compress base 12, as illustrated in FIG. 7. When required in an emergency situation, stretcher 26 to which patient transport bag 10 is attached is rushed to an injured person. The injured person is placed within base 12 on stretcher 26 and covered by top cover 28, as illustrated in FIGS. 5 and 6. Compression straps 22 are then used to compress sides 20 of base 12 to conform to the injured persons body. Referring to FIG. 1, if an oxygen tank or intravenous pump or both are required, they are positioned in pockets 48 and 50 on top cover 28 with all lines secured by straps 38.

It will be apparent to one skilled in the art the advantages that the present patient transport bag provides over the prior art. It will also be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A patient transport bag, comprising:

a one piece fabric base having a bottom and a continuous sidewall that extends upwardly from the bottom to enclose a head, a foot and opposed sides of the base and define an interior cavity;

means for securing the base to a stretcher;

a top cover detachably secured to the base, thereby providing access by medical personnel to a patient's body; and independently adjustable compression straps secured to the sidewall at intervals along the opposed sides, whereby the sidewall is compressed to accommodate contours of the patient's body.

2. The patient transport bag as defined in claim 1, wherein a mattress is positioned within the interior cavity.

3. The patient transport bag as defined in claim 1, wherein means are provided for securing one of an oxygen bottle and a ventilator to the top cover.

4. The patient transport bag as defined in claim 1, wherein means is provided to securing an intravenous pump and intravenous monitor to the top cover.

5. The patient transport bag as defined in claim 1, wherein the top cover includes a shoulder restraint yoke.

6. The patient transport bag as defined in claim 1, wherein the means for detachably securing the top cover to the base includes a two way zipper along the foot and the opposed sides.

7. The patient transport bag as defined in claim 1, wherein a pocket with a transparent window is secured to the base, such that paperwork relating to the patient can be seen through the transparent window when positioned in the pocket.

8. The patient transport bag as defined in claim 1, wherein the means for securing the base to a stretcher includes a plurality of straps.

9. The patient transport bag as defined in claim 1, wherein the at least one pocket is positioned on an inside surface of the top cover.

10. The patient transport bag as defined in claim 1, wherein the base has a removable heat retention lining.

11. A patient transport bag, comprising:

a one piece fabric base having a bottom and a continuous sidewall that extends upwardly from the bottom to enclose a head a foot, and opposed sides of the base and define an interior cavity, independently adjustable compression straps secured to the sidewall at intervals along the opposed sides, whereby the sidewall is compressed to accommodate contours of a patient's body;

a plurality of straps positioned at intervals around the base, whereby the base is secured to a stretcher;

a top cover detachably secured along the bottom and opposed sides of the base, thereby providing access by medical personnel to the patient's body;

pockets for securing medical equipment to the top cover; and straps for securing the top cover as a roll along the foot of the base.

12. The patient transport bag as defined in claim 11, wherein a mattress is positioned within the interior cavity.

13. The patient transport bag as defined in claim 11, wherein the medical equipment is one of an oxygen bottle and a ventilator.

14. The patient transport bag as defined in claim 11, wherein the medical equipment is an intravenous pump and intravenous monitor.

15. The patient transport bag as defined in claim 11 wherein the top cover includes a shoulder restraint yoke.

16. The patient transport bag as defined in claim 11, wherein the means for detachably securing the top cover to the base includes a two way zipper along the foot and the opposed sides.

17. The patient transport bag as defined in claim 11, wherein a pocket with a transparent window is secured to the base, such that paperwork relating to the patient can be seen through the transparent window when positioned in the pocket.

18. The patient transport bag as defined in claim 11, wherein at least one pocket is positioned on an inside surface of the top cover.

19. The patient transport bag as defined in claim 11 wherein the base has a removable heat retention lining.

* * * * *